United States Patent [19]

Gretzky

[11] Patent Number: 4,949,962

[45] Date of Patent: Aug. 21, 1990

[54] PINWHEEL STRUCTURE FOR BOWLING PIN SETTERS

[75] Inventor: Anthony J. Gretzky, Muskegon, Mich.

[73] Assignee: Brunswick Bowling and Billiards Corporation, Skokie, Ill.

[21] Appl. No.: 280,957

[22] Filed: Dec. 7, 1988

[51] Int. Cl.[5] ..... A63D 5/08

[52] U.S. Cl. ..... 273/43 E; 273/43 A

[58] Field of Search ..... 273/43 R, 43 A, 43 E

[56] References Cited

U.S. PATENT DOCUMENTS 3,048,397 8/1962 Holloway ..... 273/43 E 3,780,469 12/1973 Hancovsky ..... 446/108 X

*Primary Examiner*—Edward M. Coven

*Assistant Examiner*—Raleigh W. Chiu

*Attorney, Agent, or Firm*—Wood, Phillips, Mason, Recktenwald & VanSanten

[57] ABSTRACT

A pinwheel structure for transporting bowling pins from a lane upwardly to an appropriate in-feed station of a pin setter is fabricated in a modular design including a plurality of individual sections assembled to form a circular wheel frame. The sections are secured together in end-to-end relation in an arcuate manner to form a composite circular wheel. Interfacing ends are formed at opposite ends of the sections by means of flat abutting surfaces in planes radially of the circular wheel frame. Fasteners secure the sections together in a circumferential direction to clamp the flat surfaces into tight abutment.

26 Claims, 1 Drawing Sheet

PINWHEEL STRUCTURE FOR BOWLING PIN SETTERS

FIELD OF THE INVENTION

This invention generally relates to the art of apparatus for handling bowling pins and, particularly, to a pinwheel structure generally used for elevating pins from the back of a bowling lane to a pin setting machine.

BACKGROUND OF THE INVENTION

Pin setting machines have been known for many years and are used to set bowling pins in a ten-pin setup and depositing the pins at the back of a bowling lane before each turn of play by a bowler. During or after a turn of play, all of the pins are swept by some form of sweeping arm mechanism from the back of the lane, and the pins are transported, usually in an elevating manner, upwardly to an infeed station of the pin setter wherein the pins are arranged and again lowered back down onto the lane for the next turn of play.

The most common transporting mechanism for elevating the pins from the lane upwardly to the in-feed station of the pin setter has been a circular pinwheel structure which is generally channel-shaped with inner pin-receiving pockets. The pins are swept into a pit at the back of the lane whereupon the rotating pinwheel elevates the pins to the in-feed station of the pin setter.

Originally, such pinwheel structures were fabricated of steel in a spinning process by turning the wheel and forming the wheel with a tool. The pin-receiving pockets originally were formed by separate pieces either mechanically secured or welded to the interior of the wheel channel. Subsequently, a metal wheel was cast or otherwise formed with integral pockets and again processed by spinning to a circular configuration.

Such unitary pinwheel structures caused noise problems in bowling establishments because a pin striking the pinwheel created an undesirable "bell" type noise. This resulted in the design and manufacture of a two-ply pinwheel structure which, in essence, comprised inner and outer wheels which were mechanically joined together. The interface between the two halves or plies dampened the noise upon impact by the bowling pins.

Literally thousands and thousands of such pinwheel structures have been used all over the country and around the world, and a major problem arises when failures occur. The most common failure is a crack in the metal structure. This is caused because the pins are impacted against a back flange of the wheel defining the backside of the pin-receiving pockets. The advent of the two-ply wheel, which effectively dampened sound, magnified the failure problem simply because such pinwheels are not as strong as a thicker single-ply wheel.

Whenever a pinwheel failure occurs, a proprietor of a bowling establishment has one of two choices, either to repair the pinwheel structure, usually by welding, or to order a replacement pinwheel. Repairing the pinwheel causes down time and the obvious resulting loss in profits. Although a pinwheel is relatively easy to replace in assembly, replacing pinwheels also is a costly option, particularly in shipping expenses. Such a pinwheel usually is on the order of five feet in diameter, heavy and cumbersome to handle and, in fact, some parcel services do not even ship such large size items.

This invention is directed to a new and improved pinwheel structure having a modular design which not only is extremely "quiet" but solves the critical problems of repair and replacement. A failure at any point about the wheel simply is rectified by replacing a single section of the wheel. Replacement of an entire pinwheel is enhanced because the sections can be handled and shipped in a vastly more compact fashion than a full circular wheel.

SUMMARY OF THE INVENTION

An object, therefore, of the invention is to provide a new and improved pinwheel structure for transporting bowling pins from a lane upwardly to an appropriate in-feed station of a pin setter, the pinwheel being fabricated of a novel modular design.

In the exemplary embodiment of the invention, a modular circular wheel frame having a plurality of pin-receiving pockets is formed by a plurality of individual sections secured in end-to-end relation in an arcuate manner to form a composite circular wheel. The frame is channel-shaped with the pin-receiving pockets opening radially inwardly, and each section, usually seven in number, includes one of the pin-receiving pockets. Preferably, the sections are identical and stackable for easy handling and shipping prior to assembly.

Preferably, the sections are joined at interfacing ends defined by flat abutting surfaces which lie in planes radially of the circular wheel frame. In the exemplary embodiment of the invention, the flat abutting surfaces define the entire interfacing ends of the sections. Therefore, the flat abutting surfaces can be precisely machined. Fastening means are provided for securing the sections together in a circumferential direction to clamp the flat abutting surfaces into tight abutment.

With such a modular design, should a failure occur in one of the sections, that section simply is replaced by a new section, usually in situ, without even dismantling the entire pinwheel structure from its operative position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
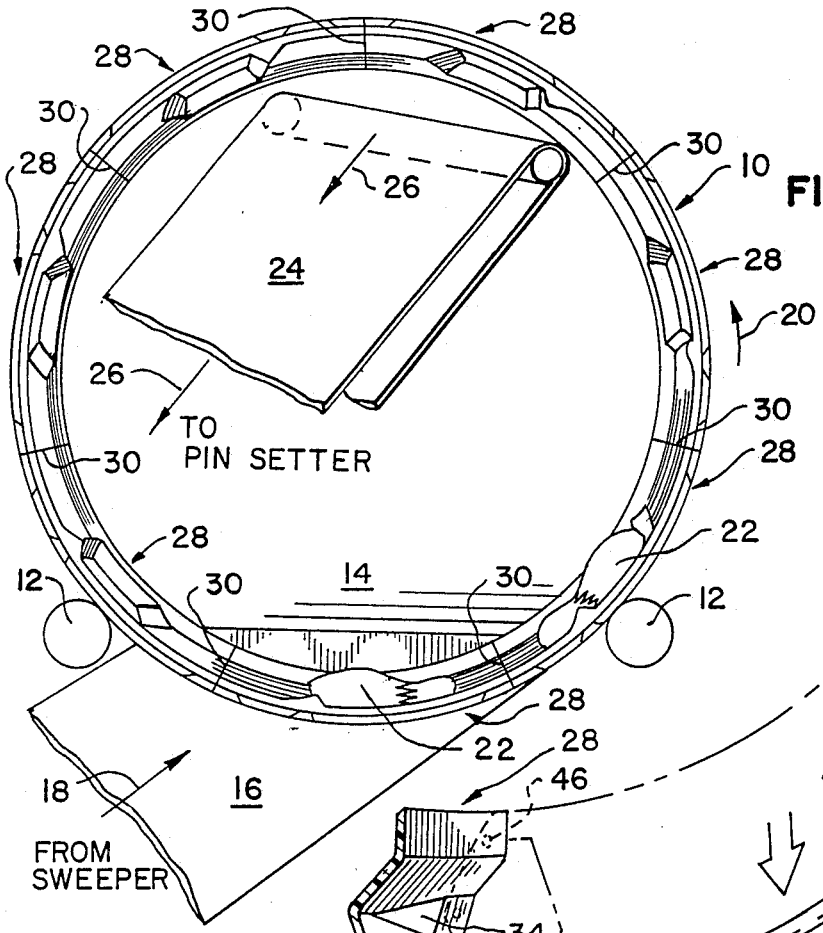
FIG. 1 is a side elevational view of the modular pinwheel structure of the invention.

Referring to the drawings in greater detail, and first to FIG. 1, a pinwheel structure designed and assembled in accordance with the concepts of the invention is shown and generally designated 10. The pinwheel is shown in conjunction with other components of a pin setting arrangement in a very schematic manner because such associated components are quite conventional and the pinwheel structure itself is advantageously usable for replacement purposes in conventional pin setter combinations. Suffice it to say, the pinwheel is appropriately supported and rotated, as schematically illustrated by a pair of support wheels 12. The back of a bowling lane is shown at 14. Conventionally, a pit 16 is formed at the back edge of the lane, and the lower portion of the pinwheel moves through the pit. Some form of sweeper mechanism sweeps bowling pins from the back of lane 14, as indicated by arrow 18, into pit 16, whereupon pinwheel 10 rotates, as in the direction of arrow 20, to carry pins 22 upwardly to an appropriate in-feed station of a pin setter or machine. Simply for illustration purposes, a conveyor 24 is shown for transporting the pins to the pin setter, as indicated by arrows 26, as the pins drop from the underside of the wheel at the top of its rotation. Of course, it should be understood that the in-feed station and transporting means of a conventional pin setter for receiving the pins from the pinwheel are more detailed.

Figure 2:
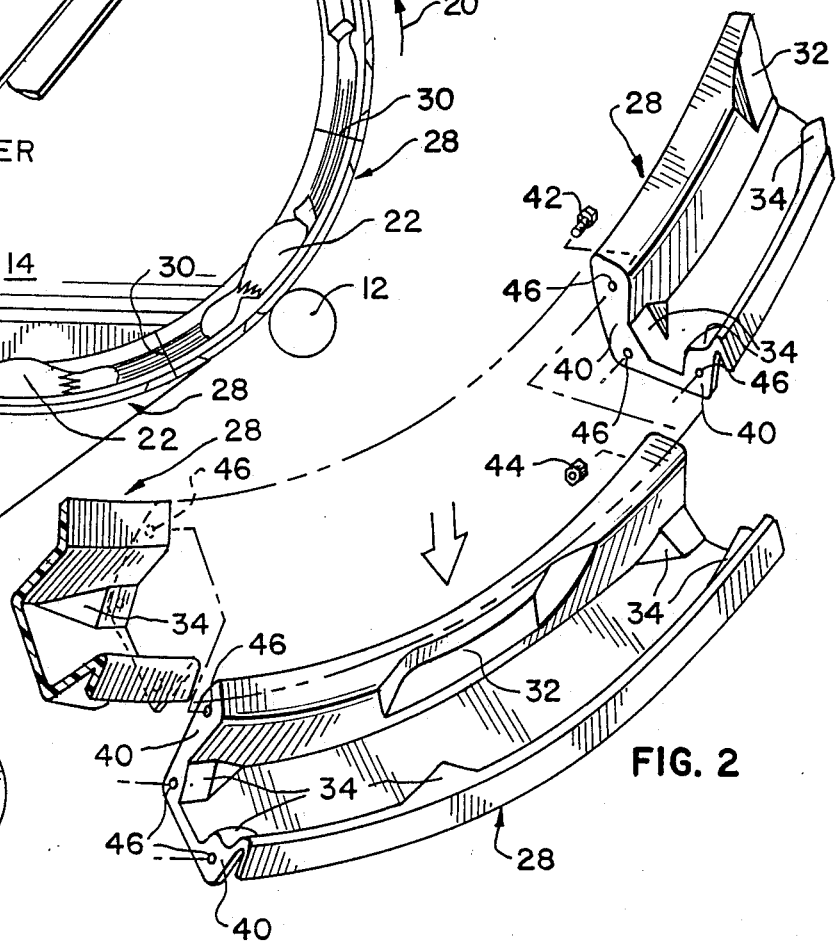
FIG. 2 is an exploded, perspective view of one of the modular pinwheel sections with fragmented ends of a pair of adjacent, adjoining sections.

Referring to FIG. 2 in conjunction with FIG. 1, the invention contemplates fabricating pinwheel structure 10 as a modular circular wheel frame having a plurality of individual sections, generally designated 28, secured in end-to-end relation in an arcuate manner to form the composite circular wheel.

When sections 28 are assembled together at interfaces 30 (FIG. 1), a composite circular pinwheel is formed of a conventional channel-shape with pin-receiving pockets opening radially inwardly. As with a one-piece pinwheel of the prior art, the pockets are formed by recessed portions 32 and projecting portions 34 which form pockets for receiving pins 22 in opposite orientations as shown in FIG. 1. Therefore, the composite multi-section pinwheel structure of the invention is totally interchangeable with one-piece pinwheel structures of similar channel-shaped pocketed configurations.

Figure 3:
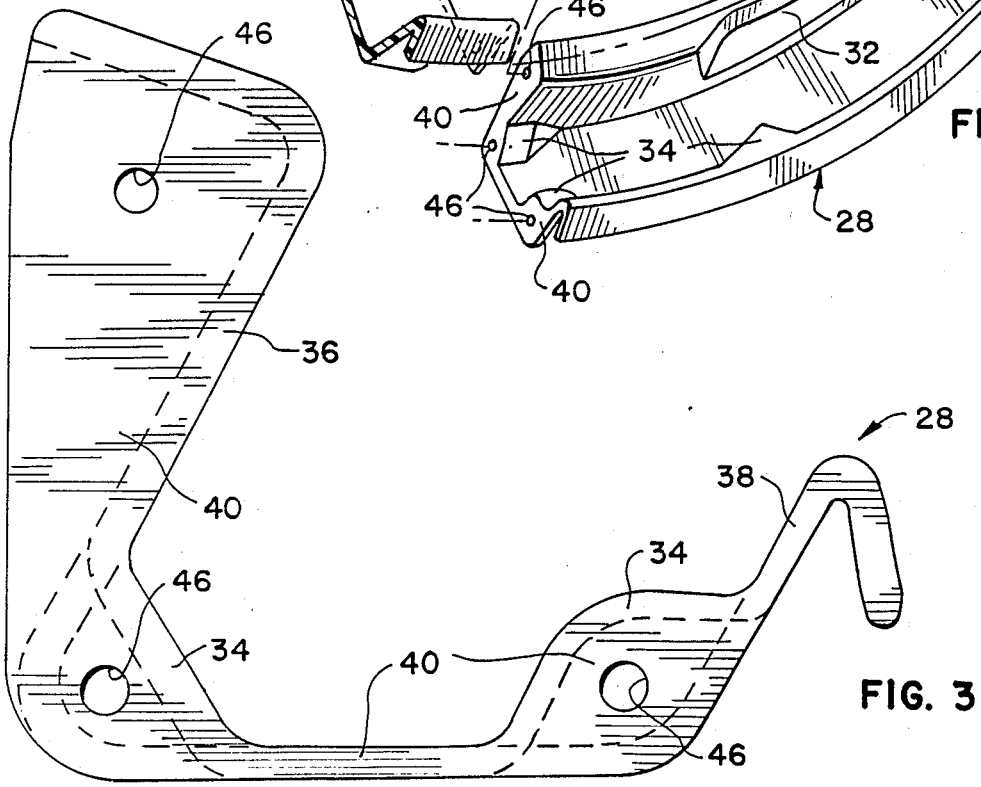
FIG. 3 is an end elevation of one of the sections, on a further enlarged scale.

As seen best in FIG. 3, the back wall or flange 36 of the pinwheel is "higher" (i.e. projects radially inwardly further) than a front flange or wall 38. During use, pins normally strike the back wall 36 of the pinwheel and these repeated impactions over extended use result in failures or cracks even with the best of designs heretofore available.

Interfaces 30 (FIG. 1) between sections 28 are formed by interfacing ends 40 of sections 28. The interfacing ends are formed by planar or flat abutting surfaces defining the entire interfacing ends of the sections. These flat abutting surfaces are precision finished to lie in planes radially of the sections and, thereby, radially of the composite circular wheel frame. The flat abutting surfaces are defined by flanged portions of the sections projecting away from the inner channel-shape of the pinwheel. Fastening means, such as bolts 42 and nuts 44 (FIG. 2) can be inserted through holes 46 in the flat surface forming flanges at the interfacing ends of adjacent sections, as depicted in FIG. 2. The fastening means then can draw the precision flat surfaces into tight abutment.

The invention contemplates that modular sections 28 can be fabricated of such materials as aluminum or plastic which are considerably lighter in weight than steel materials used to spin one-piece or two-ply pinwheels. The flat abutting surfaces 40 at the interfacing ends of the sections can be machined in the case of aluminum or ground in the case of plastic to provide for precision assembly.

The modular pinwheel structure of the invention has many advantages over conventional one-piece or two-ply pinwheels. The most obvious advantages concern the problems discussed heretofore involving failures, repairs and costs, as well as noise. By fabricating the pinwheel of a plurality of sections, the noise problem is substantially reduced as was the purpose behind designing a two-ply pinwheel, but the multiple sections substantially eliminate impaction created noise as a considered problem.

Repairing the modular pinwheel is infinitely easier than with a completely circular structure. If a failure occurs in any given section, that section simply is replaced by a new section, usually in situ, with very little down time. In fact, it has been found that once a failure occurs in a pinwheel structure of completely circular components, failures tend to follow or increase in frequency. This is believed to be the result of stress migration or shifts in stress concentration circumferentially about the wheel. With the modular concept of the invention, each interface 30 between sections 28 isolate or block such migrations.

Furthermore, the cost of fabricating the modular pinwheel structure of the invention is considerably reduced in comparison to prior pinwheels of circular component design. The much smaller sections are cast in the case of aluminum or injection molded or vacuum formed in the case of plastic. The mere size of the molds, forms or dies used to make the smaller sections is a vast cost savings over the huge dyes heretofore required to fabricate a five foot circular component. In addition, sheer volume leads to a considerable cost reduction.

Still an additional advantage not immediately contemplated is the reduced wear on associated parts which operate the pinwheel structure during use, since aluminum and plastic which can be used to fabricate the smaller sections are considerably lighter than the heavy steel materials used to fabricate large circular components. As stated above, steel was used in order to spin the large circular components to achieve as much precision and concentricity as possible.

The modular design of the invention has proven to afford some totally unexpected advantages revolving around the repeatability in manufacturing much smaller components. It has been found that a more concentric wheel actually can be constructed from seven parts, as illustrated, versus singular circular components of the prior art. This is believed to result from the fact that truer and more precision dimensions can be achieved with the smaller sections which are continuously repeated without change. It also has been found through extensive performance tests that the performance of the modular pinwheel structure is considerably enhanced. By performance is meant that jamming of pins within the pin-receiving pockets of such channel-shaped wheels does occur. With the modular design of the invention, performance has been considerably enhanced by reduced jamming, and this is believed to result again from the repeatability involved in manufacturing a smaller component wherein every segment which forms the pin-receiving pockets in the wheel is substantially identical and does not vary about the circumference of the wheel.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A pinwheel structure for transporting bowling pins from a lane upwardly to an appropriate in-feed station of a pin setter, comprising a modular circular wheel frame having a plurality of pin-receiving pockets, the frame comprising a plurality of individual arcuate sections of less than 360 and means for securing the individual arcuate sections together in end-to-end relation so that the secured arcuate sections combine to form a full 360 composite circular wheel.

2. The pinwheel structure of claim 1 wherein said frame is channel-shaped with the pin-receiving pockets opening radially inwardly.

3. The pinwheel structure of claim 2 wherein each of said sections includes one of said pin-receiving pockets.

4. The pinwheel structure of claim 1 wherein said sections are joined at interfacing ends including flat abutting surfaces.

5. The pinwheel structure of claim 4 wherein said flat abutting surfaces are in planes radially of the circular wheel frame.

6. The pinwheel structure of claim 4, including fastening means for securing the sections together in a circumferential direction to clamp the flat surfaces into abutment.

7. The pinwheel structure of claim 1 wherein each of said sections includes one of said pin-receiving pockets.

8. The pinwheel structure of claim 1 wherein said circular wheel frame is made up of seven of said sections.

9. The pinwheel structure of claim 1 wherein said sections are formed of plastic material.

10. The pinwheel structure of claim 1 wherein said sections are fabricated of aluminum material.

11. A pinwheel structure for transporting bowling pins from a lane upwardly to an appropriate in-feed station of a pin setter, comprising a modular circular wheel frame having a plurality of pin-receiving pockets, the frame comprising a plurality of individual sections secured in end-to-end relation in an arcuate manner to form a composite circular wheel, said sections being joined at interfacing ends defined entirely by flat abutting surfaces which are in planes radially of the circular wheel frame.

12. A pinwheel structure for transporting bowling pins from a lane upwardly to an appropriate in-feed station of a pin setter, comprising a modular circular wheel frame having a plurality of pin-receiving pockets, the frame comprising a plurality of individual arcuate sections and means for securing the arcuate sections together in end-to-end relation in an arcuate manner to form a composite circular wheel, the sections being joined at interfacing ends including flat abutting surfaces in planes radially of the circular wheel frame, said securing means including fastening means for securing the sections in a circumferential direction to clamp the flat surfaces into tight abutment.

13. The pinwheel structure of claim 12 wherein said frame is channel-shaped with the pin-receiving pockets opening radially inwardly.

14. The pinwheel structure of claim 12 wherein each of said sections includes one of said pin-receiving pockets.

15. The pinwheel structure of claim 12 wherein said circular wheel frame is made up of seven of said sections.

16. The pinwheel structure of claim 12 wherein said sections are formed of plastic material.

17. The pinwheel structure of claim 12 wherein said sections are fabricated of aluminum material.

18. A pinwheel structure for transporting bowling pins from a lane upwardly to an appropriate in-feed station of a pin setter, comprising a modular circular wheel frame having a plurality of pin-receiving pockets, the frame comprising a plurality of individual sections secured in end-to-end relation in an arcuate manner to form a composite circular wheel, the sections being joined at interfacing ends the entirety of which are defined by flat abutting surfaces in planes radially of the circular wheel frame, and fastening means for securing the sections in a circumferential direction to clamp the flat surfaces into tight abutment.

19. A pinwheel structure for transporting bowling pins from a lane upwardly to an appropriate in-feed station of a pin setter, comprising a modular circular wheel frame having a plurality of pin-receiving pockets, the frame comprising a plurality of individual arcuate sections and means for securing the arcuate sections together in end-to-end relation in an arcuate manner to form a composite circular wheel, said sections being joined at interfacing ends including flat abutting surfaces, and each section including one of said pin-receiving pockets.

20. The pinwheel structure of claim 19 wherein said frame is channel-shaped with the pin-receiving pockets opening radially inwardly.

21. The pinwheel structure of claim 19 wherein said flat abutting surfaces are in planes radially of the circular wheel frame.

22. The pinwheel structure of claim 19, including fastening means for securing the sections together in a circumferential direction to clamp the flat surfaces into abutment.

23. The pinwheel structure of claim 19 wherein said circular wheel frame is made up of seven of said sections.

24. The pinwheel structure of claim 19 wherein said sections are formed of plastic material.

25. The pinwheel structure of claim 19 wherein said sections are fabricated of aluminum material.

26. A pinwheel structure for transporting bowling pins from a lane upwardly to an appropriate in-feed station of a pin setter, comprising a modular circular wheel frame having a plurality of pin-receiving pockets, the frame comprising a plurality of individual sections secured in end-to-end relation in an arcuate manner to form a composite circular wheel, said sections being joined at interfacing ends the entirety of which are defined by flat abutting surfaces, and each section including one of said pin receiving pockets.

* * * * *